US007175158B2

(12) United States Patent
Thomas

(10) Patent No.: US 7,175,158 B2
(45) Date of Patent: Feb. 13, 2007

(54) TUB VALVE HAVING VERSATILE MOUNTING STRUCTURE

(75) Inventor: Kurt Judson Thomas, Indianapolis, IN (US)

(73) Assignee: Masco Corporation of Indiana, Indianapolis, IN (US)

( * ) Notice: Subject to any disclaimer, the term of this patent is extended or adjusted under 35 U.S.C. 154(b) by 483 days.

(21) Appl. No.: 10/655,099

(22) Filed: Sep. 4, 2003

(65) Prior Publication Data

US 2004/0065367 A1 Apr. 8, 2004

Related U.S. Application Data

(60) Provisional application No. 60/416,178, filed on Oct. 4, 2002.

(51) Int. Cl.
*F15K 51/00* (2006.01)
*F16K 21/00* (2006.01)

(52) U.S. Cl. ..... 251/359; 251/360; 137/315.41; 137/801; 4/678

(58) Field of Classification Search ..... 137/315.41, 137/359, 360, 801; 4/678
See application file for complete search history.

(56) References Cited

U.S. PATENT DOCUMENTS

| | | | | |
|---|---|---|---|---|
| 2,747,604 | A * | 5/1956 | Fraser | 137/360 |
| 4,662,389 | A * | 5/1987 | Igbal | 137/359 |
| 4,848,395 | A * | 7/1989 | Krippendorf | 137/359 |
| 5,010,922 | A * | 4/1991 | Agresta | 137/359 |
| 5,046,521 | A * | 9/1991 | Jensen | 137/360 |
| 5,465,749 | A * | 11/1995 | Sauter et al. | 137/315.15 |
| 5,845,673 | A * | 12/1998 | Paul | 137/360 |

* cited by examiner

*Primary Examiner*—A. Michael Chambers
(74) *Attorney, Agent, or Firm*—Carlson, Gaskey & Olds

(57) ABSTRACT

A valve assembly for installation into deck-mounted tubs includes a valve body, a top plate that engages with the valve body, a bottom plate, and an adjustment member that bears against the valve body and engages with the bottom plate. The adjustment member is accessible from above the deck and moves the top plate, valve body, and bottom plate relative to each other. This allows the valve assembly to be tightened completely from above the deck even if the bottom portion of the assembly is inaccessible. The adjustment member is a jack screw or other threaded member that can be adjusted with a conventional screwdriver, eliminating the need for specialized installation tools.

29 Claims, 3 Drawing Sheets

TUB VALVE HAVING VERSATILE MOUNTING STRUCTURE

REFERENCE TO RELATED APPLICATIONS

This application claims the priority of U.S. Provisional Appln. No. 60/416,178, filed Oct. 4, 2002, the disclosure of which is incorporated herein by reference in its entirety.

TECHNICAL FIELD

The present invention is directed toward valves and valve mounting structures mounting structures, and more particularly to a valve mounting structure that has an adjustment mechanism accessible from a top portion of the valve.

BACKGROUND OF THE INVENTION

Many new bathrooms feature tubs that are separate from a shower enclosure. These tubs may have deck-mounted tub faucets instead of conventional wall-mounted faucets. Deck-mounted faucets often are mounted on a horizontal ledge around the perimeter of the tub. This ledge may be formed integrally with the tub or built up out of ceramic tile or stone.

Standard valves used in deck-mounted tubs often are threaded around its outside diameter and can be tightened by two nuts attached to the valve, one above the deck and one below the deck. Because deck-mounted structures usually enclose the valve completely with tile or other material, the underside of the valve is inaccessible after the valve is installed. If the valve loosens due to, for example, extended use or inadequate tightening, the valve needs to be tightened both above and below the deck to remedy the problem. Because the valve is enclosed in the deck, valve tightening may involve breaking out portions of the deck and/or maneuver tools underneath the tub to reach the underside of the valve, assuming that the underside of the valve is even accessible at all.

The structure of the decks themselves poses additional problems. A conventional installation would involve threading the valve through holes in a tub ledge integrally formed with the tub. A customized installation, however, involves mounting the valve to plywood decking and then building up ceramic tile and any associated underlayment around the valve. Integral tub ledges are normally thinner than custom-formed ledges, and therefore different valve assemblies are available to accommodate these two mounting systems. Further, because customized installations may have variable thicknesses, the valve for a customized installation must be adjusted and tightened after the tile has been laid even though the underside of the valve is inaccessible after tile installation.

Attempts to remedy this problem include designing special tools, such as a threaded sleeve, that can be slipped down the deck around the valve to pull a plate, nut, or other structure upward and therefore allow valve adjustments from above the deck. These structures, however, have limited contact area between the sleeve and the structure being adjusted to tighten the valve, making it difficult to generate enough frictional force to tighten the valve with sufficient clamping force. As a result, currently known structures may still allow the valve to remain somewhat loose. Further, currently known structures require specialized tools to tighten the valve, making valve adjustment inconvenient at best and impossible for workers who do not possess the specialized tools.

There is a desire for a valve assembly for deck-mounted tubs that can be easily tightened from above the deck without requiring specialized tools. There is also a desire for a valve assembly that can be effectively installed in both conventional and customized installations.

SUMMARY OF THE INVENTION

The present invention is directed to a valve assembly that can be adjusted and tightened completely above a deck surface. The assembly includes a valve body, a top plate that engages with the valve body, a bottom plate, and an adjustment member that bears against the valve body and engaged with the bottom plate to move the top and bottom plates relative to one another. If the top plate is fixed to the top surface of the deck, tightening the adjustment member causes the bottom plate to move upward toward the top plate until it contacts the bottom surface of the deck. If the bottom plate is fixed, however, tightening the adjustment member will push the top plate and the valve body downward until the top plate contacts the top surface of the deck. In each case, the relative movement between the top plate, the bottom plate, and the valve body is the same in response to the turning of the adjustment member.

In one embodiment, the adjustment member is a jack screw or other threaded member that can be adjusted with a conventional screwdriver. This eliminates the need for specialized tools or direct access to the bottom plate.

DETAILED DESCRIPTION OF THE EMBODIMENTS

Figure 1A:
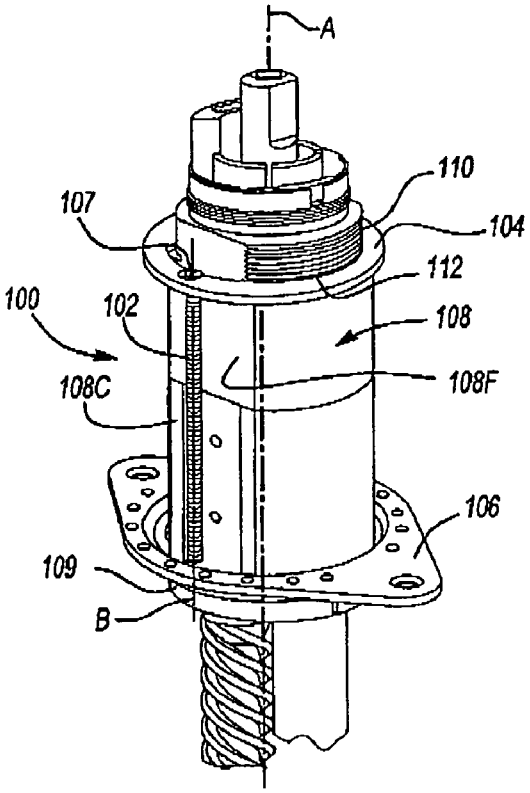
FIG. 1A is a perspective view of a valve mounting structure according to one embodiment of the invention.
Figure 1B:
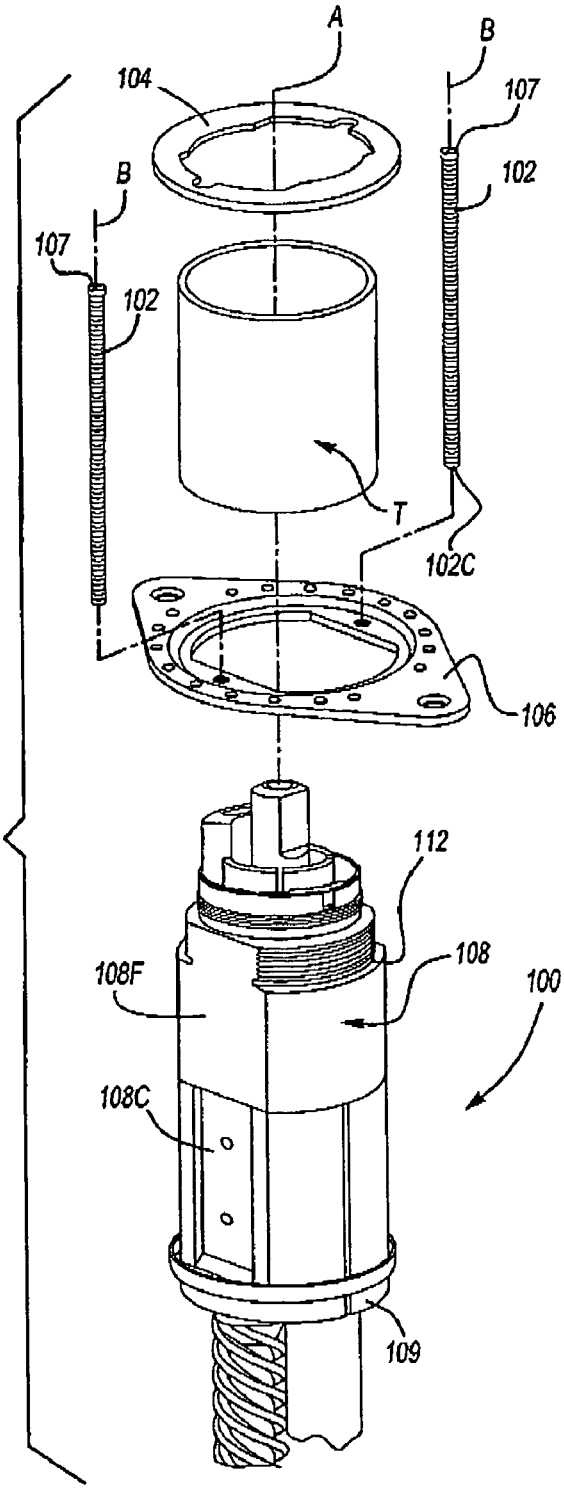
FIG. 1B is an exploded view of a valve mounting structure.

FIG. 1A illustrates a valve assembly 100 (illustrated exploded in FIG. 1B) which defines a longitudinal axis A. The inventive valve mounting structure includes an adjustment member 102 defined along an axis B generally parallel in axis A, such as a jack screw, between a top plate 104 and a bottom plate 106. In one embodiment, the adjustment member 102 is threaded, but the member 102 may have any structure that can engage and move the bottom plate 106. The adjustment member 102 does not need to be threaded along its entire length; instead, a threaded portion (not shown) can extend partially along the adjustment member 102 over a desired range corresponding to an anticipated range of deck thicknesses in which the valve assembly 100 may be installed. The adjustment member 102 has a tool mating surface 107 at its top portion which is below the top plate 104 when the top plate 104 is located within a groove 112 defined about the valve body 108. The tool mating surface 107 is shaped to accommodate any conventional tool, such as a screwdriver, Allen wrench, etc.

In one embodiment, the adjustment member 102 bears against a surface of the valve body 108. Threads (not shown) in the bottom plate 106 engage with the threaded portion of the adjustment member 102 such that when the adjustment member 102 is rotated, the bottom plate 106 moves along the valve body 108, toward or away from the top plate 104 depending on which direction the member 102 is turned.

Figure 1C:
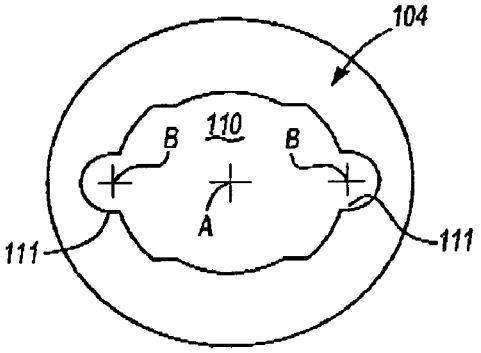
FIG. 1C is a top plan view of a top plate with a double-D opening configuration.

The top plate 104 has an opening 110 (also illustrated separately in FIG. 1C) that can accommodate both the valve body 108 and the adjustment member 102. That is, when the top plate 104 is installed, a tool opening 111 (FIG. 1C) provides access to the tool mating surfaces 107 therethrough. In one embodiment, the valve body 108 and the opening 110 in the top plate 104 is designed so that the top plate 104 can fit over the end of the valve body 108 and be rotated within the groove 112 to expose the tool mating surface 107 through a tool opening 111. The engagement between the top plate 104 and the valve body 108 ensures that they will move together if the adjustment member 102 is turned while the bottom plate 106 is fixed in a deck.

In one embodiment, the assembly 100 may have two adjustment members 102, one on each side of the valve body 108 When one adjustment member 102 is tightened, the movement of the adjustment member 102 being turned pulls the bottom plate 106 and top plate 104 closer together. The relative movement of the top and bottom plates 104, 106 also will tend to push the other, stationary adjustment member 102 upward as well and make it protrude above the surface of the deck. At this point, the bottom plate 106 will be unevenly loaded because the adjustment members 102 are not turned the same amount. The installer can then turn the protruding adjustment member 102 until both members 102 are tightened substantially the same amount, balancing the load applied to the bottom plate 106.

Further, the valve body 102 may have an outer perimeter configuration that prevents relative rotational movement. In one embodiment, the outer surface of the valve body 108 both straight and curved portions, such as a double-D shape including a flat 108F having a channel 108C within which the adjustment member 102 is partially received. The top and/or bottom plates 104, 106 have openings 110 that accommodate the double-D cross-section as well. The double-D configuration prevents the valve body 108 from twisting relative to the plates 104, 106 and ensures that the plates 104, 106 move linearly relative the valve body 108 when the adjustment member 102 is turned. Other configurations that prevent the valve body 108 from rotating out of alignment during tightening may also be incorporated; the key is to restrict relative movement of the top plate 104, bottom plate 106, and valve body 108 to linear movement when the adjustment member 102 is turned.

Figure 2:
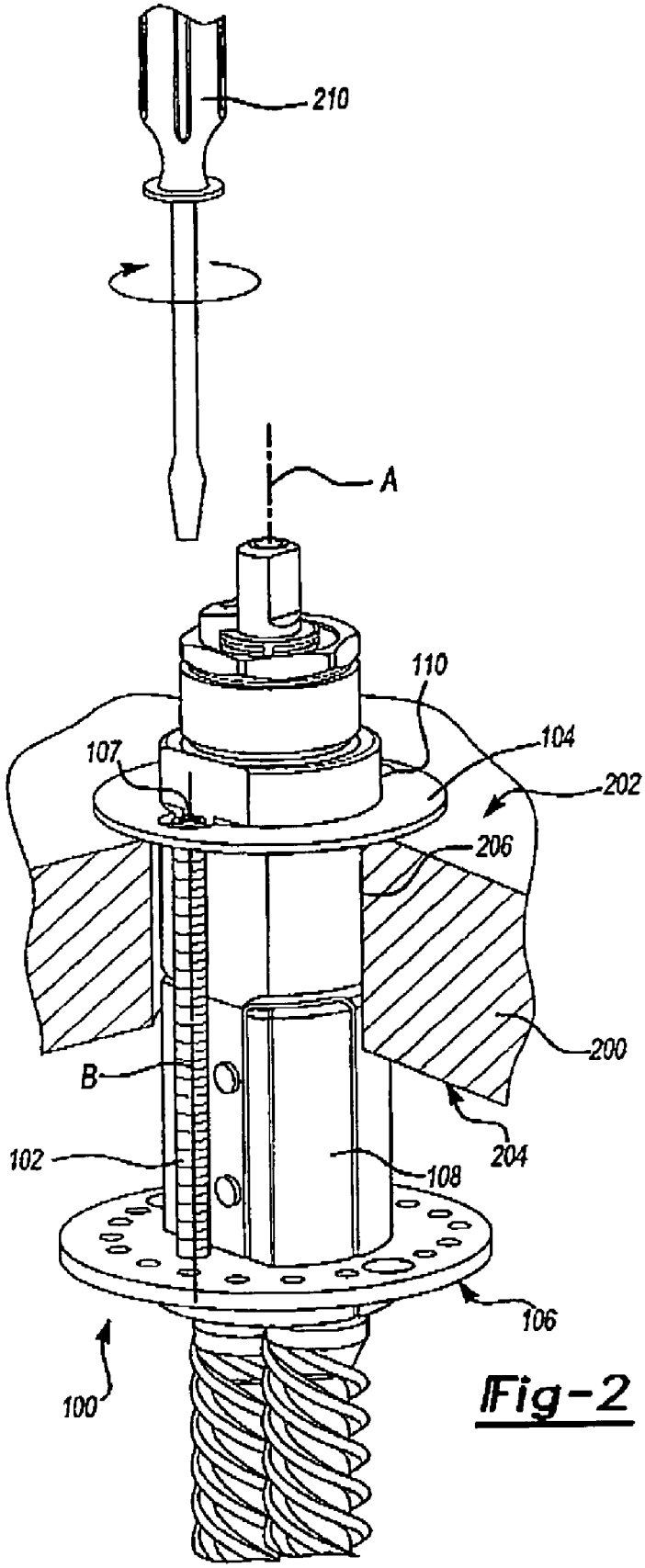
FIG. 2 is a perspective view of the mounting structure shown in FIG. 1 in a conventional installation.
Figure 3:
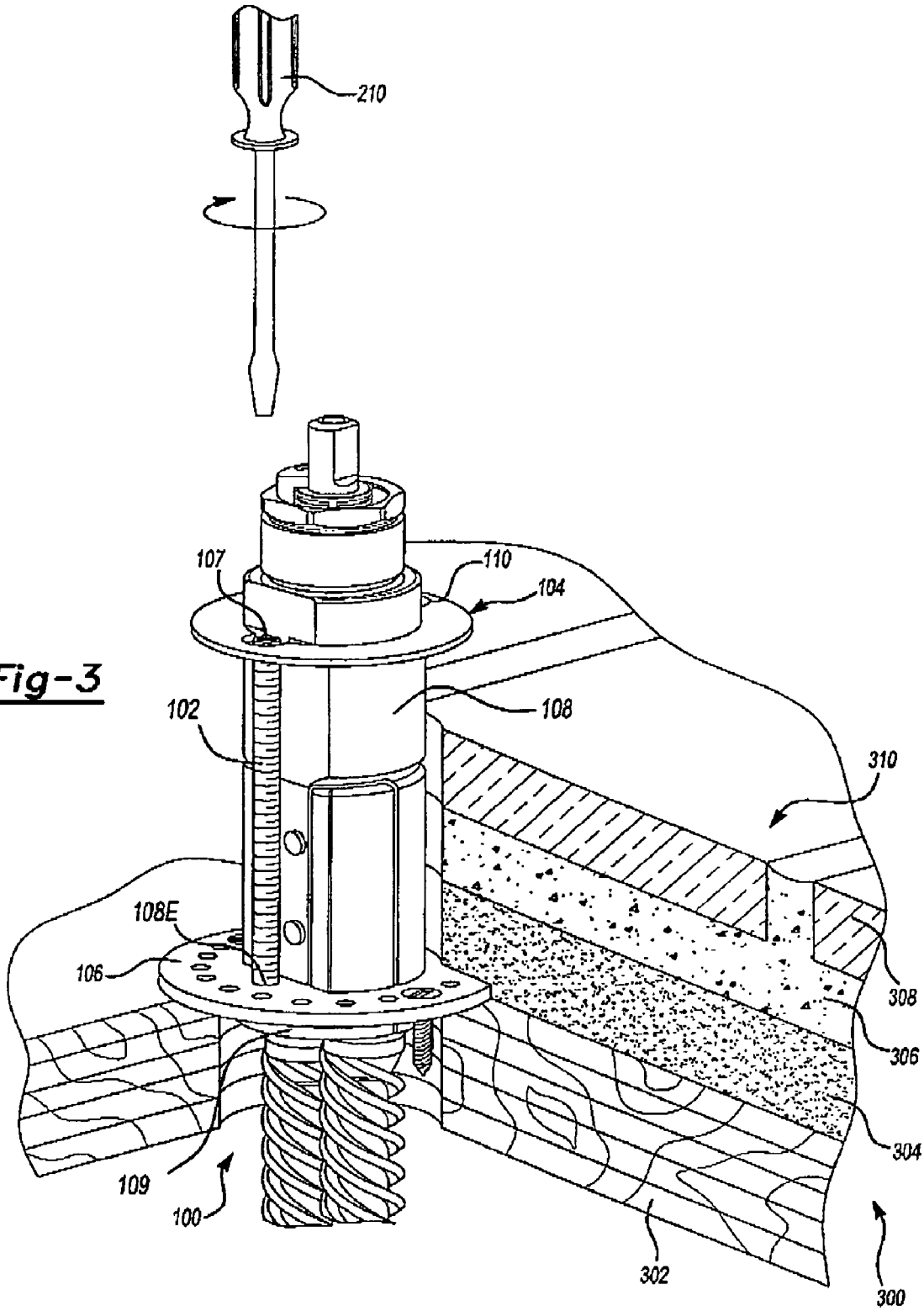
FIG. 3 is a perspective view of the mounting structure shown in FIG. 1 in a customized installation.

FIGS. 2 and 3 illustrate two possible installations of the inventive valve assembly 100. Regardless of the specific installment type, a properly installed valve assembly 100 will have the bottom plate 106 firmly against an underside of a deck. Similarly, the top plate 104 is should firmly against a top surface of the deck when the assembly 100 is properly installed. Over time, the valve assembly 100 components may loosen, warranting tightening after installation. The specific movement of the assembly components when the adjustment member 102 is turned depends on how the assembly 100 is installed in the deck.

FIG. 2 illustrates a conventional installation where the assembly 100 is installed in, for example, an integral tub ledge. As shown in the Figure, the integral tub ledge forms a deck 200 having a single layer. The deck 200 has a top surface 202, a bottom surface 204, and a mounting hole 206 that can accommodate the valve body 108.

To attach the assembly 100 to the deck 200, the top plate 104 is first removed and the valve body 108 is inserted through the mounting hole 206 from the bottom of the deck 200. The top plate 104 is then replaced over the top of the valve body 108 and twisted into the groove 108 on the valve body 108. When the top plate 104 is rotated about axis A within the groove 112 to align the adjustment member 102 with the tool opening 111 (FIG. 1C) such that the tool mating surfaces 107 are accessible through the top plate 104, the opening 110 axially locks the top plate 104 onto the valve body 108. At this point, the top plate 104 rests on the top surface 202 of the deck 202. The bottom plate 106, however, is below the bottom surface 204 of the deck, causing the valve assembly 100 to still be loose in the deck 200.

When a tool, such as a screwdriver 210, engages with the tool mating portion 107 of the adjustment member 102 and is turned, the adjustment member 102 moves the bottom plate 106 relative to the valve body 108, pulling the bottom plate 106 and top plate 104 closer together. Because the top plate 104 position is fixed against the top surface of the deck 202 in this case, turning the adjustment member 102 pulls the bottom plate 106, as shown by arrow A in FIG. 2. An installer would continue turning the adjustment member 102 until the bottom plate 106 rests firmly against the bottom surface of the deck 204. Note that although the adjustment is conducted above the deck 200, the adjustment moves a component (i.e., the bottom plate 106) disposed underneath the deck 200. Because the adjustment member 102 is still accessible after the valve assembly 100 is installed, the assembly 100 can be easily retightened if needed.

The same valve assembly 100 may also be used in a customized installation, as shown in FIG. 3. A deck 300 for a customized installation normally has a plywood base 302 with underlayment 304, mortar 306 and tile 308 built on top of the base 302. The tile layer 308 provides the top surface 310 of the deck 300.

In a customized installation, the valve assembly 100 is left intact. The bottom plate 106 is attached to the plywood base 302 with wood screws 312. The underlayment 304, mortar 306, and tile 308 are then built up around the valve assembly 100, surrounding the bottom plate 106 and fixing the bottom plate 106 firmly inside the deck 300. A guide, such as a cardboard shim T (FIG. 1C), may be located between the top plate 104 and bottom plate 106 to indicate a desired thickness for the combined underlayment 304, mortar 306 and tile layers 308 from the valve body 108. Preferably, the shim T comes installed to further simplify installation. The top plate 104 itself may also act as a guide indicating a maximum tile thickness and/or a minimum tile exposure.

Once the mortar 306 has hardened, the adjustment members 102 may be turned as explained above to tighten the assembly 100. If a guide was used, the section of the shim T which extends above the top surface 310 of the deck is cut away and the adjustment member 102 is rotated to draw the top plate 104 and valve assembly 100 downward to the top surface 310 of the deck. The top plate 104 may alternatively be removed to allow removal of the guide and then reinstalled to the valve body 108 before tightening. The adjustment member 102 will cause the top plate 104 and the valve body 108 to move downward toward the bottom plate 106 due to interaction of an end 102*e* of the adjustment member 102 and a radially extending flange 109 attached to the valve body 108. The bottom plate 106 is unable to move in this case because it is fixed inside the deck 300; therefore, turning the adjustment member 102 forces the top plate 104 and valve body 108 to move downward instead of moving the bottom plate 106 upward. The installer preferably continues turning the adjustment member 102 until the top plate 104 rests firmly against the top surface 310 of the deck. As in the example shown in FIG. 2, the adjustment member 102 remains accessible from the top of the deck 300 even though the remainder of the valve assembly 100 is embedded in the deck 300, making easy tightening of the assembly 100 possible after installation.

Regardless of the specific way the valve assembly 100 is installed, the relative movement between the valve body 108, the top plate 104 and the bottom plate 106 is the same when the adjustment member 102 is turned. The only change is the component(s) that actually moves, which is dictated by how the assembly 100 is installed and which component is fixed to the deck and thereby rendered immobile.

As a result, the inventive structure allows valve adjustment and tightening without requiring access to the bottom portion of the valve assembly. Instead, the inventive structure allows deck-mounted valve assemblies to be tightened completely from above the deck, eliminating valve access issues as well as concerns about tool clearance issues normally encountered in assemblies requiring bottom access. Further, in one embodiment of the invention, the adjustment member is designed to accommodate using conventional tools rather than specialized tools that can be lost or misplaced. The variable distance between the bottom and top plates also allow the inventive valve assembly to be used in both conventional and customized installations.

It should be understood that various alternatives to the embodiments of the invention described herein may be employed in practicing the invention. It is intended that the following claims define the scope of the invention and that the method and apparatus within the scope of these claims and their equivalents be covered thereby.

What is claimed is:

1. A valve assembly, comprising:

a valve body which defines a longitudinal axis, said valve body having a top portion, a bottom portion and a groove proximate the top portion;

a top plate engageable with said groove;

a bottom plate disposed along said valve body; and an adjustment member engaged with the bottom plate, wherein movement of the adjustment member changes a relative axial distance between the top plate and the bottom plate.

2. The valve assembly of claim 1, wherein at least one of the valve body, the top plate, and the bottom plate restrict rotational movement when the adjustment member changes the relative axial position of the top plate and the bottom plate.

3. The valve assembly of claim 2, wherein the valve body has a double-D cross section and the top plate and bottom plate each have a double-D opening to accommodate the valve body.

4. The valve assembly of claim 1, wherein the adjustment member comprises a tool mating portion.

5. The valve assembly of claim 4, wherein the tool mating portion is a slot that accommodates a screwdriver.

6. The valve assembly of claim 1, wherein at least a portion of the adjustment member and the bottom plate is threaded, and wherein the threaded portions of the adjustment member and the bottom plate engage.

7. The valve assembly of claim 1, wherein the top plate has an opening adjacent a tool opening to expose the tool mating surfaces when the top plate is in a first rotational position within the groove.

8. The valve assembly of claim 1, wherein the top plate is axially movable along said valve body when the top plate is in a second rotational position.

9. The valve assembly of claim 1, wherein the top plate has an opening which corresponds to a cross-section of the valve body, the valve body having a non-circular cross-section.

10. The valve assembly of claim 1, wherein the valve body has a double-D cross section and the top plate and bottom plate each have a double-D opening to accommodate the valve body to prevent relative rotation therebetween except when said top plate is received within said groove.

11. A valve assembly, comprising:

a valve body which defines a longitudinal axis, said valve body having a non-circular cross-section and a groove;

a top plate having a tool opening adjacent an opening which corresponds to said a non-circular cross-section, said top plate having a tool opening adjacent said opening to expose a tool mating surfaces when said top plate is in a first rotational position in which said top plate is axially locked within said groove;

a bottom plate disposed along said valve body; and an adjustment member engageable with said bottom plate, said adjustment member defining said tool mating surface, a relative axial distance between said top plate and said bottom place adjustable in response rotation of said adjustment member.

12. The valve assembly of claim 11, wherein said opening is contiguous with said tool opening.

13. The valve assembly of claim 11, wherein said top plate is axially movable along said valve body when said top plate is in a second rotational position.

14. The valve assembly of claim 11, wherein said bottom plate includes an opening which corresponds to said a non-circular cross-section, said bottom plate axially movable along said valve body.

15. The valve assembly or claim 14, wherein said bottom plate includes a multitude of fastener openings.

16. The valve assembly of claim 14, wherein said bottom plate includes a screw opening.

17. The valve assembly of claim 11, wherein said non-circular cross section defines a double-D cross section and said top plate and said bottom plate each have a double-D opening to accommodate said valve body to prevent relative rotation therebetween except when said top plate is received within said groove.

18. The valve assembly of claim 11, wherein said adjustment member defines a second axis parallel to said longitudinal axis.

19. The valve assembly of claim 18, wherein said valve body includes a channel within which said adjustment member is at least partially received.

20. The valve assembly of claim 19, wherein said channel is locate within a flat defined by said valve body cross section.

21. The valve assembly of claim 20, wherein said flat defines a portion of said valve body a double-D cross section.

22. A method of installing a valve assembly comprising the steps of:

(A) installing a valve assembly through an opening in a deck from a bottom side of the deck;

(B) installing a top plate onto the valve assembly;

(C) rotating the top plate within a groove in the valve assembly to align a tool opening in the top plate with a tool mating surface of an adjustment member;

(D) rotating the adjustment member to reduce an axial distance between the top plate and a bottom plate to trap the deck therebetween.

23. A method as recited in claim 22, wherein said step (C) further comprises:

(a) rotating the top plate within the groove to axially lock the top plate to the valve assembly.

24. A method as recited in claim 22, wherein said step (D) further comprises:

(a) threading the adjustment member through the bottom plate.

25. A method of installing a valve assembly comprising the steps of:

(A) attaching a bottom plate of a valve assembly to a base of a deck;

(B) building the deck around the valve assembly;

(C) installing a top plate onto the valve assembly;

(D) rotating the top plate within a groove in the valve assembly to align a tool opening in the top plate with a tool mating surface of an adjustment member; and (E) rotating the adjustment member to reduce an axial distance between the top plate and a bottom plate to trap the deck therebetween.

26. A method as recited in claim 25, wherein said step (A) further comprises:

(a) screwing the bottom plate of the valve assembly to the base.

27. A method as recited in claim 25, wherein said step (C) further comprises:

(a) cutting a tubular guide away from the valve assembly after said step (B).

28. A method as recited in claim 25, wherein said step (E) further comprises:

(a) rotating the adjustment member to react an end of the adjustment member against a radial flange which extends from said valve assembly; and (b) drawing the valve assembly downward through the bottom plate until the top plate contacts a top surface of the deck.

29. A method as recited in claim 25, wherein said step (B) further comprises:

(a) installing an underlayment and tile layer onto the base.

* * * * *

UNITED STATES PATENT AND TRADEMARK OFFICE

CERTIFICATE OF CORRECTION

PATENT NO. : 7,175,158 B2
APPLICATION NO. : 10/655099
DATED : February 13, 2007
INVENTOR(S) : Kurt Judson Thomas It is certified that error appears in the above-identified patent and that said Letters Patent is hereby corrected as shown below:

Claim 11, Column 6, line 23: "place" should be --plate--

Claim 15, Column 6, line 34: "or" should be --of--

Signed and Sealed this

First Day of May, 2007

JON W. DUDAS
*Director of the United States Patent and Trademark Office*